United States Patent [19]

Stange et al.

[11] 4,159,824

[45] Jul. 3, 1979

[54] METHOD FOR REVERSING THE DIRECTION OF TRAVEL OF A SHEET

[75] Inventors: Klaus K. Stange, Pittsford; Richard E. Smith, Webster; Thomas J. Hamlin, Macedon; James R. Cassano, Penfield, all of N.Y.

[73] Assignee: Xerox Corporation, Stamford, Conn.

[21] Appl. No.: 857,329

[22] Filed: Dec. 5, 1977

Related U.S. Application Data

[63] Continuation of Ser. No. 794,691, May 6, 1977, abandoned, which is a continuation of Ser. No. 664,847, Mar. 8, 1976, abandoned.

[51] Int. Cl.[2] ..... B65H 5/22; B65H 9/00

[52] U.S. Cl. ..... 271/3; 271/184; 271/195; 271/236; 271/DIG. 9; 302/2 R; 406/13; 406/70

[58] Field of Search ..... 271/3, DIG. 9, 186, 271/196, 195, 65, 97, 236, 184; 302/2 R, 29, 31; 355/24, 26, 3 R; 360/88, 91; 353/25, 27 R, 27 A

[56] References Cited

U.S. PATENT DOCUMENTS

| | | | |
|---|---|---|---|
| 3,293,414 | 12/1966 | Barcia | 302/2 R X |
| 3,834,799 | 9/1974 | Blosser et al. | 271/195 X |
| 3,918,706 | 11/1975 | Craft | 271/195 X |
| 3,944,212 | 3/1976 | Stange et al. | 271/DIG. 9 |

*Primary Examiner*—Bruce H. Stoner, Jr.

[57] ABSTRACT

A method for changing the direction of travel of a sheet includes the steps of providing a pocket, guiding a sheet traveling in a first direction into the pocket, and providing a fluid stream in the pocket to bias the sheet in a substantially opposite direction, thereby reversing the direction of travel of the sheet.

3 Claims, 2 Drawing Figures

METHOD FOR REVERSING THE DIRECTION OF TRAVEL OF A SHEET

This is a continuation of application Ser. No. 794,691 filed May 6, 1977, now abandoned which was a continuation of application Ser. No. 664,847, filed Nov. 8, 1976 now abandoned.

The subject invention relates to methods for changing the direction of travel of sheets, such as paper.

Persons skilled in the art of paper handling are aware that a need frequently arises for devices capable of acting on a sheet moving in one direction to reverse its direction of travel. In fact, one such device is disclosed in U.S. Pat. No. 3,944,212, Sheet Reversing Mechanism, filed on Nov. 25, 1974, on an invention by Klaus K. Stange and Erwin J. Strobel, Jr., said application being assigned to the assignee herein, Xerox Corporation. More particularly, the patent discloses a xerographic machine in which there is located a reverser. The reverser includes first and second rolls forming a first roll pair to receive copy sheets, the first roll being driven in a sheet forwarding direction and the second roll being freely rotatable for co-action therewith. A second roll pair formed by the first roll and a third roll which is freely rotatable is adapted to feed the sheet in a reverse direction. A third roll pair downstream from the first and second roll pairs is provided with an idler roll and a cooperating single revolution-eccentric roll adapted to feed the sheet in the same direction as the second roll pair when the eccentric roll is actuated in response to sensing means adapted to sense the passage of the trailing edge of the sheet out of the nip of the first roll pair. Obviously, the distance between the third roll pair and the other roll pairs places a limitation on the smallest size of paper which may be fed into the apparatus for reversal.

It is an object of the present invention to provide a method for reversing the direction in which a sheet is traveling wherein fluid is used to drive a sheet in a generally opposite direction.

It is another object of the present invention to provide a method for reversing the direction in which a sheet is traveling, the method including a step wherein the sheet is aligned before its direction of travel is reversed.

Briefly, the subject invention provides a method for changing the direction of travel of a sheet and includes the steps of: (a) providing a pocket; (b) guiding a sheet traveling in a first direction into the pocket; and (c) providing a first fluid stream in the pocket to bias the sheet in a substantially opposite direction.

In contrast to the prior art set forth in the application, since a third roll pair is not required, the range of lengths of sheets which may be reversed according to the inverted method, for a pocket having an equivalent downstream length, is greater.

Figure 2:
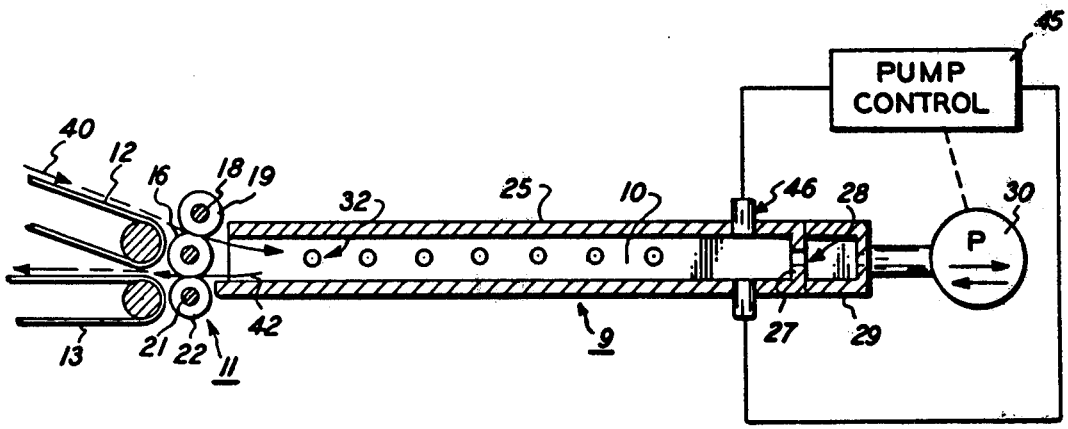
Figure 1:
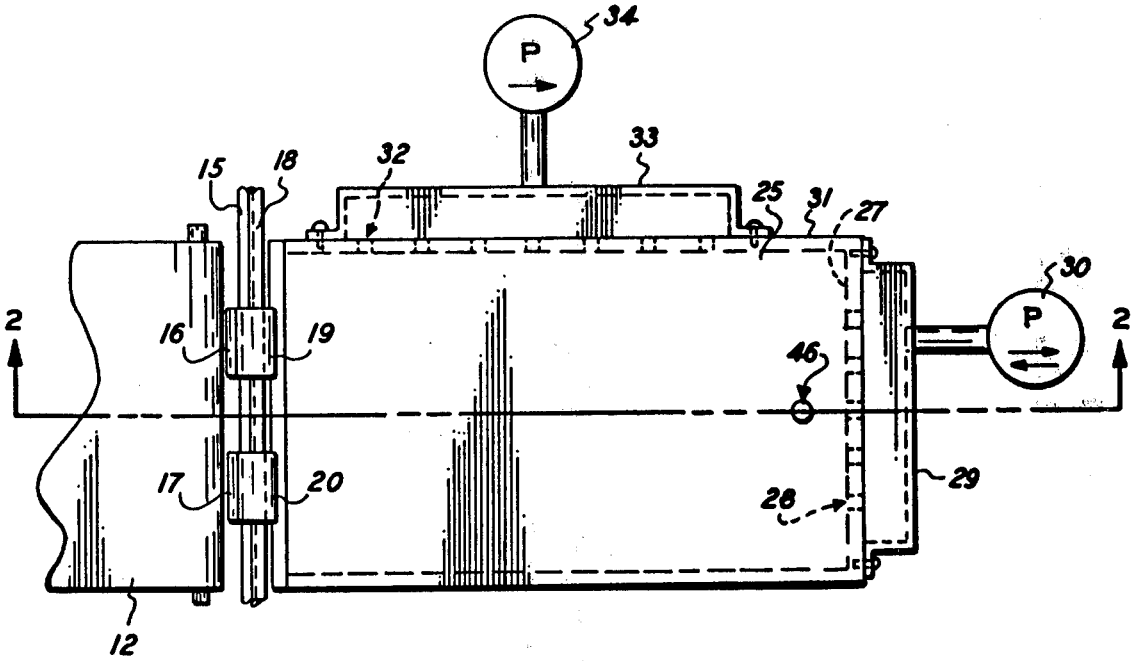

Additional objects and features of the invention will become apparent by reference to the following description in conjunction with the accompanying drawings, in which:

FIG. 1 is a top-plan view of apparatus which may be used to practice the subject invention; and FIG. 2 is a cross-sectional view of the apparatus, taken along line 2—2 in FIG. 1.

Referring to FIGS. 1 and 2, apparatus for practicing the subject invention may include a fluidic device 9, a roller arrangement 11 for guiding sheets into and out of a rectangular pocket 10 of the device, a conveyor 12 for moving sheets into engagement with the roller arrangement, and a conveyor 13 for moving sheets discharged by the roller arrangement away.

The roller arrangement includes a driven rod 15 on which a pair of rollers 16 and 17 are secured and a fixed rod 18 on which a pair of idler rollers 19 and 20 are rotatably mounted, rollers 19 and 20 cooperating with rollers 16 and 17, respectively, to provide nips for feeding sheets of, for example, paper to the pocket. Further, the roller arrangment includes a fixed rod 21 on which a pair of idler rollers 22 (only one shown) cooperate with rollers 16 and 17 to provide nips for discharging sheets moving out of the pocket. From the foregoing, it will be appreciated that only one drive (not shown) is required to power the roller arrangement.

Fluidic device 9 includes a rectangular structure 25 having, as previously mentioned, a pocket 10. The back wall 27 of the structure includes a linearly aligned group of holes 28 and supports a manifold 29 whose chamber communicates with the pocket via the group of holes. Manifold 29 is coupled to a reversible pump 30 and, therefore, fluid may be drawn from or may be injected into the pocket. Similarly, a narrow side wall 31 of the structure includes a number of linearly aligned holes 32 and supports a manifold 33 whose chamber communicates with the pocket via said number of holes. Manifold 33 is coupled to a vacuum pump 34 and, consequently, may be used to draw fluid from the pocket.

The apparatus described may be operated in several ways. For example, a rectangular sheet of paper moving on conveyor 12, as indicated by arrow 40, may be injected into the pocket by the rollers 16, 17, 19, and 20. During injection, pump 30 may be operated in a pressure mode. As a result, when the sheet is released by the rollers, its momentum is overcome by fluid flowing out of the pocket, and its direction of travel is reversed. Consequently, the roller arrangement moves the sheet as indicated by arrow 42 and the sheet is moved away by conveyor 13. In another mode of operation, when a sheet is fed to the rollers 16, 17, 19, and 20, pump 30 may be operated in a vacuum mode. As a result, when rollers 16, 17, 19, and 20 release the sheet it is brought into registration with wall 27. Thereafter, pump 30 is operated in a pressure mode. The fluid stream generated in the pocket by pump 30 moves the sheet into engagement with the roller arrangement and the sheet is discharged. It should be noted that if the sheet is substantially flat and if the flow of fluid is uniform, the alignment resulting from the registration will be maintained as sheets are driven into the roller arrangement. The latter is particularly true when sheets fed are only a little bit shorter than the length of the pocket. When more precise alignment is desired, pump 34 may be operated. Pump 34 draws sheets in the pocket against wall 31, and the wall serves as a guide when a sheet is being driven out of the pocket by a fluid stream provided by pump 30.

When pump 30 is being used to both draw and inject fluid, it may be actuated automatically by a control 45 which is responsive to an electric eye arrangement 46 mounted on the wide walls of the structure near wall 27. As will be apparent to those skilled in the art of detection, control 45 may include a monostable circuit which in its stable state causes the pump to operate in a vacuum mode until a sheet is detected. Thereafter, the circuit may cause the pump to operate as a fluid source for a predetermined interval of time. For sheets of a particular length and weight, the time interval may be adjusted such that the pump injects fluid for a period of time which is just sufficient to bring the initially trailing edge of a sheet into engagement with drive rollers 16 and 17 and idler rollers 22 (only one shown) and then returns to a vacuum mode to assist a sheet entering the pocket. From the foregoing it will be apparent that entering and leaving sheets may be simultaneously present, at least in part, in the pocket.

It is to be understood that the foregoing has been set forth only as an example of how the invention defined by the following claims may be practiced and should not be construed so as to place limitations on the claims.

What is claimed is:

1. A method for reversing the direction of movement of sheets of paper of varying dimensions comprising the steps of:

providing a substantially enclosed pneumatic pocket having greater dimensions than said sheets for receiving said sheets and containing said sheets fully within said pocket;

mechanically inserting a paper sheet into an open side of said pocket in a first direction of movement with a first continuously operating mechanical sheet transport;

releasing said sheet inside said pocket from said first mechanical sheet transport;

applying a reversing fluid stream through said pocket, after said sheet has been released inside said pocket, in a second direction opposite from said first direction of movement of said sheet, to reverse the direction of movement of said sheet and to move said sheet back out of the same open side of said pocket into a second continuously operating mechanical sheet transport;

wherein said reversing fluid stream is actuated for a pre-determined time interval in response to the sensing of the presence of the lead edge of said sheet at a known position inside said pocket by sheet detection means, after said sheet has been released by said first mechanical sheet transport;

aligning said sheet in said pocket by applying a transverse fluid stream in said pocket after said sheet is released by said first mechanical sheet transport, said transverse fluid stream being applied in a direction transverse said second direction of said reversing fluid stream to bias said sheet against a side wall of said pocket to align said sheet as it is moved out by said pocket to said second mechanical sheet transport by said reversing fluid stream; and transporting said sheet away from said pocket with said second mechanical sheet transport in said second direction of movement.

2. The method of claim 1, wherein a vacuum mode fluid stream is applied in said pocket during the inserting of said sheet into said pocket by said first mechanical sheet transport to draw the leading edge of said sheet traveling in said first direction of movement into abutment with a back wall of said pocket, said vacuum mode fluid stream being terminated prior to the application of said reversing fluid stream.

3. The method of claim 2, wherein said predetermined time interval for which said reversing fluid stream is actuated is adjusted to a period of time which is just sufficient to bring the initially trailing edge of said sheet into engagement with said second mechanical sheet transport, and wherein said vacuum mode fluid stream is then automatically reapplied while another sheet is inserted in said pocket by said first mechanical transport and is simultaneously present in said pocket with said sheet.

* * * * *